US007223331B2

(12) United States Patent
Stark et al.

(10) Patent No.: US 7,223,331 B2
(45) Date of Patent: May 29, 2007

(54) METHOD FOR SETTLING SUSPENDED FINE INORGANIC SOLID PARTICLES FROM HYDROCARBON SLURRY AND ADDITIVE FOR USE THEREWITH

(75) Inventors: Joseph L. Stark, Richmond, TX (US); Robert S. Lauer, Missouri City, TX (US); Lawrence N. Kremer, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 405 days.

(21) Appl. No.: 10/455,847

(22) Filed: Jun. 6, 2003

(65) Prior Publication Data

US 2004/0019248 A1 Jan. 29, 2004

Related U.S. Application Data

(63) Continuation-in-part of application No. 09/778,517, filed on Feb. 6, 2001, now abandoned.

(60) Provisional application No. 60/181,242, filed on Feb. 9, 2000.

(51) Int. Cl.
*C10M 175/00* (2006.01)

(52) U.S. Cl. ..... 208/108; 208/181; 208/298; 585/864; 585/833; 585/866

(58) Field of Classification Search ..... 585/864, 585/833, 865, 866; 208/180, 181, 298
See application file for complete search history.

(56) References Cited

U.S. PATENT DOCUMENTS

| | | | | |
|---|---|---|---|---|
| 2,875,157 | A | 2/1959 | Kirkpatrick et al. | 252/344 |
| 2,944,983 | A | 7/1960 | De Groote et al. | 252/344 |
| 2,944,984 | A | 7/1960 | De Groote et al. | 252/344 |
| 3,296,117 | A | 1/1967 | Ross et al. | 208/11 |
| 3,330,757 | A | 7/1967 | Bichard | 208/11 |
| 3,331,765 | A | 7/1967 | Canevari et al. | 208/11 |
| 3,582,489 | A | 6/1971 | Meadow et al. | 204/190 |
| 3,782,472 | A | 1/1974 | Siess, Jr. | 166/303 |
| 4,058,453 | A | 11/1977 | Patel et al. | 208/188 |
| 4,272,360 | A | 6/1981 | Bialek | 208/188 |
| 4,302,326 | A | 11/1981 | Bialek | 208/188 |
| 4,321,147 | A | 3/1982 | McCoy et al. | 210/708 |
| 4,382,852 | A | 5/1983 | McCoy et al. | 208/188 |
| 4,384,977 | A | 5/1983 | Duke | 252/344 |
| 4,396,499 | A | 8/1983 | McCoy et al. | 208/188 |
| 4,600,500 | A | 7/1986 | Dickakian | 208/177 |
| 4,692,237 | A | 9/1987 | Hsu et al. | 208/177 |
| 4,814,394 | A | 3/1989 | Barthold et al. | 525/405 |
| 5,593,572 | A | 1/1997 | Hart | 208/177 |
| 6,316,685 | B1 | 11/2001 | Lauer et al. | 585/864 |

*Primary Examiner*—Tam M. Nguyen
(74) *Attorney, Agent, or Firm*—Madan, Mossman & Sriram, P.C.

(57) ABSTRACT

Disclosed is a method for settling suspended finely divided inorganic solid particles from a hydrocarbon slurry using an additive. The additive comprises (a) a hydroxy-terminated polyoxyalkylate chain(s) containing polymer having at least one oxygen atom and at least one nitrogen atom and, optionally, (b) other components such as a solvent, an acid or mixtures thereof.

17 Claims, No Drawings

METHOD FOR SETTLING SUSPENDED FINE INORGANIC SOLID PARTICLES FROM HYDROCARBON SLURRY AND ADDITIVE FOR USE THEREWITH

CROSS REFERENCES TO RELATED APPLICATIONS

This application is a continuation in part of the U.S. patent application having the Ser. No. 09/778,517 filed Feb. 6, 2001, now abandoned which application claims priority from the U.S. Provisional Patent Application having the Ser. No. 60/181,242 filed Feb. 9, 2000.

BACKGROUND OF THE INVENTION

1. Field of the Invention

This invention relates to a method for settling suspended finely divided solid, particularly inorganic solid, particles from a hydrocarbon. This invention particularly relates to a method for settling such solids from a hydrocarbon using a additive.

2. Background of the Invention

Solid settlement or separation or removal may be very important for naturally occurring formation fluids such as crude oil or crude oil from tar sand, oil shale or other naturally occurring bitumen, bottoms from various oil refining processes, resid and numerous streams from chemical or polymer plants. All of these streams are known to exist as slurries and contain different types and varying amounts of suspended finely divided solid particles. These finely divided solid particles could be inorganic materials such as sand, clay, dirt or catalyst, insoluble organic compounds, organometallic compounds, or mixtures of such insoluble organic, inorganic and organometallic compounds. These solid particles could exist in a wide range of sizes and shapes. In general, larger or coarser particles are easier to separate than smaller or finer particles of the same density.

If crude oil, crude oil from tar sand, oil shale or other naturally occurring bitumen, or other formation fluids contain a high concentration of suspended solid particles, it may not be feasible to use or process the feedstock in an existing plant or refinery. The solid particles need to be completely or substantially separated from other products in the slurries as part of a purification step. Typically, the suspended solid particles are first rendered to settle. Then, they are separated and removed. Recovery and production of minerals or metals also may require similar types of settlement and separation of inorganic solid particle products from aqueous slurries.

Many different methods and equipment have been used to settle, separate, remove or recover from a variety of slurry mixtures, as discussed in the foregoing examples, the suspended finely divided solid particles. These methods and equipment include sedimentation, magnetic separation if the particles are magnetic, and/or use of processing equipment such as hydrocyclones and centrifugal separators. In processes where direct physical and/or mechanical separations are not economical, technically feasible, or fast enough, different chemicals may be used to effect, aid, improve and/or accelerate settling of such finely divided solid particles upon standing, storage, centrifugation or other ways. For instance, U.S. Pat. No. 5,481,059 discloses uses of adducts between alkylphenolformaldehyde resin alkoxylate compound and polyacrylic acid to aid solid particle settlement. U.S. Pat. No. 5,476,988 discloses a method of accelerating settlement of finely divided solids from hydrocarbon fluids and slurries by adding certain quaternary fatty ammonium compounds to the slurries.

To be effective, it is generally desirable to use chemical aids, additives and/or polymers that are large, easy to separate and/or capable of forming a settled phase with the finely divided solids suspended in the slurry through various interactions. Such interactions include, but are not limited to, chemical, physical, electrostatic, Van Der Waals, or a combination thereof. It is also desirable to form a settled phase, a sludge or other forms of precipitation between the solids and the additive that are more readily separable from the fluid or liquid phase of the slurry using conventional equipment. Furthermore, it would be advantageous to accelerate the settling of the finely divided solids, especially inorganic solids, to shorten the settling time required to achieve the desired level of residual solids in the fluid/liquid phase. This would help reduce the size of the settling tank or other related equipment and/or increase the throughput of the process. It also would be an advantage if these chemical aids, additives or polymers are (a) readily available or prepared or (b) more effective than those already known or (c) both.

SUMMARY OF THE INVENTION

In one aspect, the present invention is a method for settling suspended finely divided inorganic solid particles from a high solids hydrocarbon, the method comprising: (a) admixing an effective amount of an additive with a high solids hydrocarbon containing suspended finely divided inorganic solid particles; and (b) allowing the inorganic solid particles to settle and form a settled phase, wherein the additive is an amine or alkanolamine initiated polyether; the hydrocarbon includes less than 2 percent water by weight; the effective amount of the additive is in the range of from about 300 ppm to about 10,000 ppm, by volume, of the hydrocarbon; at least 50 percent by weight of the total amount of the finely divided solid particles present and/or suspended in the slurry, are settled; and the method excludes a subsequent addition of water to the hydrocarbon prior to allowing the inorganic particles to settle and form a settled phase.

In another aspect, the present invention is an additive useful for aiding the settling of suspended finely divided inorganic solid particles from a hydrocarbon comprising (i) a polyether prepared by a polyoxyalkylation of an amine or an alkanolamine initiator, (ii) an acid, and (iii) a diluent.

DETAILED DESCRIPTIONS OF THE INVENTION

The present invention relates to an improved method for separating or settling suspended finely divided inorganic solid particles from a slurry by contacting an additive with the slurry, followed by allowing the solids to settle to form a settled phase. The additive is used in an effective amount to effect settling or accelerated settling and/or improved settling of the finely divided solid particles, particularly inorganic solid particles. The invention also relates to the composition of an additive, which comprises a polymer or a polymer mixture with two or more polymers and, optionally, an acid, a diluent, a solvent or mixtures thereof. There may be optionally other compounds in the additive for a particular application as well. The composition is used to effect separation, settling, accelerated settling or improved settling of the suspended finely divided solid particles from the slurry, particularly a hydrocarbon slurry such as crude oil, crude oil derived from tar sand, oil shale or other naturally occurring bitumen, or other formation fluids. Solid particles commonly existing in crude oil from tar sand, oil shale, or other naturally occurring bitumen, include clays, sand, minerals, dirt, metals and mixtures thereof.

When there are solid particles in a liquid or fluid, it is generally referred to as a slurry. The particles may float to the top of, suspend in and/or settle to the bottom of the fluid/liquid phase. Depending on particle size, particle size distribution, density and other physical and chemical properties or conditions, it is also possible that a certain combination of these possibilities may exist. It is also known that the physical state of a slurry may be stable, meta-stable or even constantly changing upon standing, storage, and/or being subjected to other processing conditions such as centrifugation, agitation, magnetic field, hydrocyclone treatment, temperature change, additive treatment or others.

In most processes, it is necessary that the suspended solid particles in a slurry should be separated and/or removed as much as possible from the fluid or liquid in order to reduce plant operation problems. In a number of processes, particularly those for producing metals, minerals, other inorganic compounds and/or polymers, the solids suspended in the slurry themselves are actually the desired products. Regardless of the specific processes or byproducts involved, it is usually preferable, at least for plant throughput and equipment size determination purposes, to make the solids separation and/or settlement as fast, effective and/or as easy as possible. It is within the embodiment of the present invention to effect accelerated and/or improved settling of the solids, particularly finely divided inorganic solid particles. It is also within the embodiment of the present invention to have improved settlement even though the settlement may or may not be accelerated. For instance, the precipitation or sludge or settled phase formed or the solid particles themselves may become easier to separate or remove due to changes of their physical or chemical or surface properties.

The term "finely divided", as used herein, means that the particles of the solid(s) present in a slurry are small enough so that they do not settle readily to the bottom or near the bottom of the fluid by gravity, with or without using other physical means within about one hour under the conditions of interest.

Accordingly, the range of those solids or solid particles considered to be "finely divided" in the present invention may vary somewhat depending on the composition as well as the chemical and physical properties of both the solid particles and the slurry. For the purpose of the present invention, solid particles smaller than about 200 micrometers (microns or μ) may be considered as "finely divided" in the various fluids disclosed herein. Particles as large as 1000μ may be considered to be "finely divided," particularly for certain slurries with high viscosity and/or density.

Because of the many requirements for reducing downstream product processing problems, the finely divided solid particles should be completely or at least mostly or substantially removed from the slurry. The amount of solid particles remaining in the slurry product after being subjected to the present invention should be below about 0.2 wt % of the total amount of slurry, preferably below about 0.1 wt %, more preferably below 0.06 wt %, all based on the weight of the slurry. The residual solid particles in the slurry present after treatment and work-up are also referred to as "ash" herein, after an ashing step at 800° C.

In terms of relative amounts of solid particles removed or settled out of the slurry followed by removal, it is preferred that effective amounts of the additive are used under conditions effective to remove or separate at least 50%, more preferred at least 70%, by weight, of the total amount of the finely divided solid particles, particularly inorganic particles, present and/or suspended in the slurry.

The terms "hydrocarbon(s)" and "hydrocarbon fluid(s)" used herein are not limited only to those compounds or streams or products or fluids containing only carbon and hydrogen in their compositions. A number of other elements may be present in a "hydrocarbon," including, but not limited to oxygen, nitrogen, sulfur, phosphorus, silicon, and metals. General examples of hydrocarbon(s) or hydrocarbon fluid(s) include, but are not limited to, crude oil, crude oil derived from tar sand, oil shale or other naturally occurring bitumen, various formation fluids, resids, methanol or oxygenate conversion products and byproducts, various refinery bottoms, polymerization products and byproducts, other chemical reaction products and byproducts or bottom streams, fermentation byproducts, extraction byproducts, recycled or reclaimed products and byproducts from chemical reactions, waste streams from a chemical plant, combinations thereof and others.

"Hydrocarbon slurry" is used herein to mean a mixture, which is comprised of the finely divided solid particles and the hydrocarbon(s) or hydrocarbon fluid. Preferably, the hydrocarbon treated by the method of the of the present invention has less than about 2 percent, more preferably less than about 1 percent water concentration. Most preferably, the hydrocarbon has less than about 0.5 percent water concentration. Preferably, the hydrocarbon treated by the method of the present invention is a naturally occurring one and is a high solids hydrocarbon such as tar sand, oil shale or other naturally occurring high solids crudes and bitumen, such as the very high solids crude oils from the Cold Lake and Lloydminister fields from Canada and the SJV (San Joachim Valley) crude from California, USA, wherein the solids levels can exceed 100 to 500 pounds per thousand barrels produced.

An additive suitable for use in the present invention to separate and or settle the finely divided solid particles, particularly inorganic solid particles, from the slurry comprises a polymer or a polymer mixture and, optionally, an acid, a solvent, a diluent or a mixture thereof. Examples of suitable solvents or diluents are AS 220 or AS 160, which comprise high aromatic naphtha, and HAN® from Exxon, FINASOL® 150 from Petro-Fina S.A and mixtures thereof.

In addition to the polymer, the additive may also include a sulfonic acid selected from the group consisting of alkyl sulfonic acid, aromatic sulfonic_acid such as benzene sulfonic acid or substituted benzene sulfonic acid and mixtures thereof. Alkylbenzene sulfonic acid is a preferred sulfonic acid.

Of the alkylbenzesulfonic acids, the para isomers are preferred. An alkylbenzene sulfonic acid consisting essentially of para-dodecylbenzene sulfonic acid is more preferred. It is also within the embodiments of the present invention to have some ortho- and meta-substituted isomers in the para isomer. In addition, ortho or meta isomers may be used alone or as mixtures without substantial amount of the para-substituted isomer present. There may be additional substituents on the benzene ring, such as other alkyl group(s), aryl group(s), halide(s) (F, Cl. Br), and mixtures thereof.

Two or more different aromatic sulfonic acids such as alkylbenzene sulfonic acids disclosed herein may be used in the same additive regardless the makeup of the rest of the additive.

Examples of alkylsulfonic acids suitable for use in the additive include, but are not limited to linear $C_1$–$C_{12}$ alkyl sulfonic acids, branched $C_1$–$C_{12}$ alkyl sulfonic acids, cyclic alkyl sulfonic acids having five to twelve carbon atoms, amino function containing alkyl sulfonic acids having five to twelve carbon atoms, and mixtures thereof, such as methane sulfonic acid, ethanesulfonic acid, 1- or 2-propane sulfonic acid, 1-butanesulfonic acid, 1-decanesulfonic acid, 2-aminoethane sulfonic acid, 3-aminopropane sulfonic acid, 2-(cyclohexylamino)ethane sulfonic acid, 3-cyclohexylamino-1-propane sulfonic acid, their corresponding salts similar to those salts listed above for the alkylbenzene sulfonic acid, i.e. $NH_4^+$, Na, and others, and mixtures thereof. In addition to the amino group disclosed above, there may be certain different and/or additional substituents on alkyl group, including halide(s), i.e. halogen-substituted, such as Cl, F and Br, aryl group(s) and mixtures thereof. These sulfonic acids may be obtained from Aldrich Chemical Company and other chemical companies.

The polymer or polymer mixture used in the additive for settling and/or separating solids from a hydrocarbon slurry oil has, comprises or consists essentially of one or more polymers. The polymer comprises at least one material selected from the product of polyoxyalkylating an amine or alkanol amine initiator wherein the resulting polyoxyalkylate chains are derived from ethylene oxide (EO), propylene oxide (PO), butylene oxide (BO) and mixtures thereof. Other epoxides or their chemical equivalents may also be used, including $C_5$–$C_{10}$ epoxides, cyclic epoxides and mixtures thereof.

Suitable initiators for the additives of the present invention include ethylene diamine, diethylene triamine (DETA), triethylene pentamine, piperazine and 1,2-cyclohexane diamine. Also useful as initiators with the present invention are methoxylamine, ethanolamine, diethanolamine, triethanolamine, all of the isomers of 1-amino-2-propanol, 3-amino-1-propanol, all of the amino-butanol isomers, all of the amino-pentanol isomers, and mixtures thereof. Other useful amines consist essentially of 4-(3-aminopropyl)-morpholine, morpholine or mixtures thereof or mixtures with other amines. Hydroxylamines also may be used alone or with other amines. Examples of useful hydroxylamines include diethylhydroxylamine (DEHA) and tris(hydroxymethyl) aminomethane. Any amine or hydroxylamine having active hydrogens which can be reacted with an epoxide to from a polyether can be used as an initiator for preparing an additive of the present invention.

The polyethers useful as the additives of the present invention can be prepared by any method known to be useful to those of ordinary skill in the art of making such materials. Preferably the polymers are prepared by the oxyalkylation of suitable initiators by methods that include the addition of an epoxide to a solution of an initiator in the presence of a basic catalyst. The epoxides can be added as blocks or as a mixed feed. The resulting polyethers of such a process are hydroxy terminated.

Preferably, the additives of the present invention are prepared using EO and PO. It is preferred that the molar ratio of PO to EO is in the range of from about 100:1 to about 1:1, more preferred that the range is from 50:1 to 1:1, and most preferred that the range is from 2:1 to 1:1. It is preferred that the range of moles of epoxide to mole of initiator be from about 10:1 to about 500:1, preferably from about 40:1 to about 400:1, and most preferably from about 100:1 to about 300:1.

It is also within the scope of the present invention to use two or more different polymers disclosed herein in the same additive, regardless of the makeup of the rest of the additive. Examples of suitable additives for use in practicing the method of the present invention include BPR 44855, BPR 44865 and mixtures thereof. Both are available from Baker Petrolite, a division of Baker Hughes, Incorporated.

All of the polymers suitable for use in the present invention, particularly for treating hydrocarbon slurries such as crude oil, crude oil derived from tar sand, oil shale or other naturally occurring bitumen, may be soluble, partially soluble or insoluble in the hydrocarbon slurry under the conditions of the disclosed method.

It is optional and preferred to have other components such as diluent or solvent in the additive. Examples of such a component include or consist essentially of an organic solvent or solvent mixture, such as AS220 and AS160, which can be obtained from Nissiki Corporation. It comprises high aromatic naphtha. Other nonexclusive examples of such diluent or solvent include HAN from Exxon and Finasol 150 from Petro Fina S.A.

While organic solvents and the like can be used with the method of the present invention, water washing occurring after the introduction of the additive into the hydrocarbon and prior to the settling of an inorganic particle phase is not an embodiment of the present invention. Introduction of water into the hydrocarbon in amounts of 1 percent by weight of the hydrocarbon, or more, can reduce the economic advantages of the method of the present invention. The method of the present invention excludes a subsequent addition of water to the hydrocarbon prior to allowing the inorganic particles to settle and form a settled phase. The method of the present invention particularly excludes a subsequent addition of water to the hydrocarbon prior to allowing the inorganic particles to settle and form a settled phase wherein the water addition to the hydrocarbon is an addition of at least 1 percent water by weight. Such an addition where in the water addition to the hydrocarbon is an addition of at least 2 percent water by weight is also excluded as an embodiment of the present invention.

The various components of the additive may be premixed before the additive is added to and mixed with the hydrocarbon slurry. Alternately, all or part of the components may be added separately to the slurry simultaneously or consecutively or a combination thereof. The additive should be mixed sufficiently with the slurry during or after additive addition to provide effective contacting between the additive and the slurry. The mixing can be effected by using various mechanical mixers or any other suitable means or methods known to those skilled in the art.

In a suitable additive, the polymer or polymer mixture, if more than one polymer is used for the additive, is present in the range of from about 3% to 100%, preferably from about 10% to about 80%, more preferably from about 35% to about 65%, all by weight, of the total amount of the additive. The solvent or diluent is present in the additive in the range of from 0% (i.e. no solvent or diluent) to about 97%, preferably from about 15% to about 90%, more preferably from about 30% to about 70%, all by weight, of the total amount of the additive. There may be additional components or compounds in the composition of the additive as well.

The total quantity of the additive added to a slurry must be an effective amount to effect the desired settling of the suspended finely divided solid particles. This effective amount, typically at least 50 ppm, depends on many characteristics of the additive as well the slurry such as surface area, number of particles and surface chemistry. A suitable amount is in the range of from about 50 ppm to about 10,000 ppm, preferably from about 300 ppm to about 3,000 ppm, more preferably from 500 ppm to about 1,500 ppm, all in volume relative to the volume of the slurry to be treated. It is also within the embodiment of the present invention to use an amount of the additive higher than the upper limit of 10,000 ppm by volume.

The treatment temperature is the temperature at which the additive is added to or in contact with the slurry having the suspended solid particles. It is also referred to herein as injection temperature. For the present invention, this treatment temperature is in the range of from about 20° C. to about 600° C., preferably from about 30° C. to about 450° C. It is more preferred to have a treatment temperature in the range of from about 40° C. to about 200° C. when the hydrocarbon fluid is crude oil from tar sand, oil shale, or other naturally occurring bitumen.

The time period for carrying out the treatment or injection is not critical. A convenient and sufficient time is allowed for contacting, mixing, and/or admixing the additive and the slurry. This time depends on a number of factors including, but not limited to, the mode of contact, the equipment, the particle size of the slurry, the additive used, the concentration of the additive required, the nature of the slurry and combinations thereof. It is generally preferred to keep this time period as short as possible while maintaining the effectiveness of the treatment with sufficient contacting between the additive and the slurry.

The settling temperature at which the finely divided solids are allowed to settle to form a settled phase may or may not be the same as the treatment temperature. If it is different, the settling temperature can be the same as, lower or higher than the treatment temperature. A suitable range of the settling temperature for the present invention is in the range of from about 30° C. to about 250° C. A preferred range for settling finely divided inorganic solid particles is in the range of from about 50° C. to about 150° C., more preferably from about 60° C. to about 100° C.

The time period for carrying out the desired settling or settlement of the solids depends on a number of factors, including, but not limited to, the type of solid particles, the amount of solids present in the slurry, the required level of solids removal, the desired throughput of the unit, the additive used, the effectiveness of the additive used, the settling conditions and combinations thereof. A typical range of the time period is in the range of from about ten (10) minutes to about ten days. It is preferred to be from about one (1) hour to about five days, more preferred from about eighteen (18) hours to about four days. It is sometime desirable to obtain a time-dependent profile of settling of the solid particles by measuring the settlements of the solids at different times.

It is also within the embodiment of the present invention to use the additives according to the foregoing disclosures in conjunction with other methods or apparatus or equipment known in the prior art. For instance, it may be beneficial for separating or settling finely divided solid particles from certain slurries by using the additive or the improved method of this invention in a centrifugal separator as a better or improved way allowing the solid particles to separate under a set of conditions.

As already disclosed and discussed earlier, within the embodiment of the present invention is also a composition of an additive for separating and/or settling suspended finely divided solid particles, particularly inorganic particles, from a hydrocarbon slurry such as crude oil or crude oil derived from tar sand or other formation fluids, wherein the composition comprises a polymer and, optionally, a diluent or a solvent. More than one polymer may be used in the same additive composition. More than one additive may be used in a single method.

The following examples are intended to illustrate certain specific embodiments of the present invention. When reading the examples with the rest of the application, one having ordinary skill in the art would appreciate the teachings of these examples with respect to the disclosures and the claims of the present invention.

EXAMPLE 1

Blanks, Control Experiments

A general procedure for determining the amount of inorganic solid particles and/or residual solid particles, also referred to collectively as ash, in a slurry such as slurry oil, crude oil derived from tar sand, crude oil is carried out as follows:

A sample of a Canadian crude oil containing suspended finely divided solid particles is used for all the experiments. The crude is heated to about 49° C. (120° F.) so that it becomes fluid enough for complete mixing with an additive by applying either a two-minute mechanical mixing or a one hundred to about one hundred and fifty shakings by hand.

A ten-milliliter (10 ml) aliquot is drawn off from the slurry sample and placed in a dry and pre-weighed crucible. After being allowed to cool to room temperature (about 23° C. to about 25° C.), the crucible containing the sample is weighed again to determine the total amount of the sample slurry oil in the crucible. This sample is then placed in a muffle furnace to be ashed at a temperature of 800° C. in air for about 16 hours (overnight). See ASTM D 482–87. The crucible along with the ash is placed in a dissector to cool to room temperature. It is re-weighed to determine the original pre-treatment and pre-settling amount of solids/solid particles (also referred to as ash) in the slurry oil sample. If preferred, this procedure may be repeated a number of times.

The results of the blank experiments are shown in Table I, Runs 1 and 2. These results establish the amount of inorganic materials and/or components (ash) present in the Canadian crude oil sample.

Experiment 2

General Procedure

A number of two-hundred-milliliter (100 ml) samples of the uniform well-mixed oil from Experiment 1 are poured into separate settling bottles. Between each sampling, the slurry oil is re-mixed well or otherwise rendered uniform throughout.

These samples are heated to the desired treatment temperature, also called dosage temperature or injection temperature, of 49° C. (120° F.). After reaching the treatment temperature, the additive, in predetermined amounts, is added to the settling bottles. For each set of experiments, at least one sample should be preferably used as a blank control without the additive.

These samples in the settling bottles are then brought to the desired settling temperature by heating in an oven, oil bath or water bath, depending on which would be most convenient for a particular settling temperature. As stated before, the treatment temperature and the settling temperature may be the same or different. A convenient settling temperature is 49° C. (120° F.).

Once the settling temperature is reached, the mixture of the sample is then mechanically mixed for about two minutes or mixed by shaking thoroughly (about 100 to 150 shakings). The samples are then allowed to stand for a pre-determined time period for settling without disturbance. Unless otherwise indicated, samples are withdrawn at 24-hour intervals. When trying to obtain a time-related profile of solid settlements, aliquots are withdrawn at different time periods.

At the time of withdrawals, a ten-milliliter (10 ml) aliquot is taken and placed in a pre-weighed crucible to be ashed at 800° C. overnight (about 16 hours) and the solid content measured by a procedure as described above. For the final withdrawal, the top fifty milliliters (50 ml) of the slurry are removed carefully without upsetting the solids settled at the bottom of the settling bottles.

The solid content is calculated according to the following equation:

$$\frac{Weight_{crucible\ and\ ash} - Weight_{crucible}}{Weight_{crucible\ and\ slurry\ oil} - Weight_{crucible}} \times 100$$

It is sometimes preferable to run more than one sample for each particular additive or condition to determine the reproducibility and accuracy as well as precision of the experiments.

EXAMPLE 4

The general procedure described above is used with the following specific parameters and conditions. Before the samples are placed into the settling bottles, they are subjected to mechanical mixing for about two minutes to ensure uniformity of the samples.

The treatment temperature is about 49° C. (120° F.). The settling temperature is about also 49° C. (120° F.). The settling time period is 24 hours.

The results of using different polymers in the additive in different amounts are shown below in Tables I & II. BPR 44855 and BPR 44865 are commercial products from Baker Petrolite. They possess structures falling within the definitions of additives as defined and claimed herein.

TABLE I

| Run No. | Additive | Additive Dosage, ppm by Volume | Time (hr) | Weight % of Solids |
|---|---|---|---|---|
| 1 | Blank | 0 | 24 | 0.267 |
| 2 | Blank | 0 | 24 | 0.240 |
| 3 | BPR 44855 | 100 | 24 | 0.218 |
| 4 | BPR 44855 | 200 | 24 | 0.220 |
| 5 | BPR 44865 | 100 | 24 | 0.235 |
| 6 | BPR 44865 | 200 | 24 | 0.235 |

TABLE II

| Run No. | Additive | Additive Dosage, ppm by volume | Weight % of Ash |
|---|---|---|---|
| 7 | BPR 44855 | 1000 | 0.036 |
| 8 | BPR 44865 | 1000 | 0.165 |

EXPERIMENT 5

Experiment 4 is repeated with BPR 44855 and BPR 44865 for a setting period of 48 hours. The results are set forth in TABLE III.

TABLE III

| Run No. | Additive | Additive Dosage, ppm by volume | Weight % of Ash |
|---|---|---|---|
| 9 | BPR 44855 | 1000 | 0.149 |
| 10 | BPR 44865 | 1000 | 0.026 |

Experiment 6

Experiment 4 is repeated comparing two different batches of BPR 44855 formulated with different aromatic solvents. The results are set forth in TABLE IV.

TABLE IV

| Run No. | Additive | Additive Dosage, ppm by volume | Weight % of Ash |
|---|---|---|---|
| 11 | BPR 44855 | 1000 | 0.036 |
| 12 | BPR 44855* | 1000 | 0.032 |

*With a different source of aromatic solvent.

EXAMPLE 7

Experiment 4 is repeated using several different additives. The results are set forth in TABLE V.

TABLE V

| Run No. | Additive* | Additive Dosage, ppm by volume | Weight % of Ash# |
|---|---|---|---|
| 13 | A | 1000 | 0.044 |
| 14 | B | 1000 | 0.221 |
| 15 | C | 1000 | 0.039 |
| 16 | D | 1000 | 0.029 |
| 17 | E | 1000 | 0.116 |

*A: 79% tetraethylenepentamine (TEPA) with block copolymer polyoxyalkylate chains prepared from 1.38/1 (molar ratio) PO/EO; and 21% DDBSA. Total epoxide to TEPA molar ratio is 219:1.
B: 80% diethylenetriamine (DETA) with block copolymer polyoxyalkylate chains prepared from 2.67/1 (molar ratio) PO/EO; and 20 % DDBSA. Total epoxide to DETA molar ratio is 110:1.
C: 90% DETA with block copolymer polyoxyalkylate chains prepared from 8/1 (molar ratio) PO/EO; and 10% DDBSA. Total epoxide to DETA molar ratio is 90:1.
D: 86% DETA with block copolymer polyoxyalkylate chains prepared from 2.1/1 (molar ratio) PO/EO; and 14% DDBSA. Total epoxide to DETA molar ratio is 155:1.
E: 80% DETA with block copolymer polyoxyalkylate chains prepared from 1.31/1 (molar ratio) PO.EO; and 20% DDBSA. Total epoxide to DETA molar ratio is 185:1.
#measured after 24 hours.

A number of theories discussed herein are solely for the purposes of easy understanding and better appreciation of the present invention by one skilled in the art. They are not intended to limit either the scope or the spirit the invention in any manner. Similarly, the foregoing examples and any preferred embodiments also are intended for illustration purposes only. They are not intended and should not be interpreted to limit the spirit or the scope of the invention, which is described by the entire written disclosure herein and defined by the claims below.

What is claimed:

1. A method for settling suspended finely divided inorganic solid particles from a high solids hydrocarbon, the method comprising:

(a) admixing an effective amount of an additive with a high solids hydrocarbon containing suspended finely divided inorganic solid particles; and (b) allowing the inorganic solid particles to settle and form a settled phase, wherein the additive is an amine or alkanolamine initiated polyether; the hydrocarbon includes less than 2 percent water by weight; the effective amount of the additive is in the range of from about 300 ppm to about 10,000 ppm, by volume, of the hydrocarbon; at least 50 percent by weight of the total amount of the finely divided solid particles present and/or suspended in the slurry, are settled; and the method excludes a subsequent addition of water to the hydrocarbon prior to allowing the inorganic particles to settle and form a settled phase;

wherein the settling of the inorganic solid particles is accomplished by a process selected from the group consisting of gravity settling, filtration, centrifugation, cyclone separation, magnetic separation and combinations thereof.

2. The method of claim 1 wherein the hydrocarbon is a crude oil derived from a tar sand, oil shale or other naturally occurring bitumen.

3. The method of claim 1 wherein the additive is prepared by a block polyoxyalkylation of an amine or an alkanolamine initiator.

4. The method of claim 3 wherein the polyoxyalkylation is performed using an epoxide selected from the group consisting of ethylene oxide, propylene oxide, butylene oxide and mixtures thereof.

5. The method of claim 4 wherein the polyoxyalkylation is performed using ethylene oxide and propylene oxide.

6. The method of claim 1 wherein the additive is prepared by a random polyoxyalkylation of an amine or an alkanolamine initiator.

7. The method of claim 6 wherein the polyoxyalkylation is performed using an epoxide selected from the group consisting of ethylene oxide, propylene oxide, butylene oxide and mixtures thereof.

8. The method of claim 7 wherein the polyoxyalkylation is performed using ethylene oxide and propylene oxide.

9. The method of claim 1 wherein the additive is prepared by admixing an amine or alkanolamine initiator with a solvent and a catalyst with an epoxide or mixture of epoxides in a molar ratio of epoxide to initiator of from about 10:1 to about 500:1.

10. The method of claim 9 wherein the additive is prepared by admixing an amine or alkanolamine initiator with a solvent and a catalyst with an epoxide or mixture of epoxides in a molar ratio of epoxide to initiator of from about 40:1 to about 400:1.

11. The method of claim 10 wherein the additive is prepared by admixing an amine or alkanolamine initiator with a solvent and a catalyst with an epoxide or mixture of epoxides in a molar ratio of epoxide to initiator of from about 100:1 to about 300:1.

12. The method of claim 11 wherein the epoxide or mixture of epoxides is a mixture of propylene oxide and ethylene oxide and the molar ratio of propylene oxide to ethylene oxide is from 2:1 to 1:1.

13. The method of claim 2 wherein the crude oil derived from a tar sand, oil shale or other naturally occurring bitumen has a water content of less than 1 percent.

14. The method of claim 13 wherein the crude oil derived from a tar sand, oil shale or other naturally occurring bitumen has a water content of less than 0.5 percent.

15. The method of claim 1, wherein the additive further comprises an acid and a solvent.

16. The method of claim 1, wherein the effective amount of the additive is in the range of from about 500 ppm to about 1500 ppm, by volume, of the hydrocarbon.

17. The method of claim 15, wherein the acid consists essentially of dodecylbenzene sulfonic acid.

* * * * *